US008756712B2

(12) United States Patent
Goodman

(10) Patent No.: US 8,756,712 B2
(45) Date of Patent: Jun. 24, 2014

(54) TZITZIT GARMENT

(75) Inventor: Tamir Goodman, University Heights, OH (US)

(73) Assignee: Tamir Goodman Sports Consultant, LLC, University Heights, OH (US)

( * ) Notice: Subject to any disclaimer, the term of this patent is extended or adjusted under 35 U.S.C. 154(b) by 206 days.

(21) Appl. No.: 13/310,294

(22) Filed: Dec. 2, 2011

(65) Prior Publication Data

US 2012/0180186 A1 Jul. 19, 2012

Related U.S. Application Data

(60) Provisional application No. 61/432,308, filed on Jan. 13, 2011.

(51) Int. Cl.
*A41D 13/00* (2006.01)

(52) U.S. Cl.
USPC ..... 2/69; 2/102; 2/113; 2/115

(58) Field of Classification Search
USPC ..... 2/102, 114, 106, 88, 95, 97, 109, 112, 2/113, 272
See application file for complete search history.

(56) References Cited

U.S. PATENT DOCUMENTS

| | | | | | |
|---|---|---|---|---|---|
| 2,051,274 | A * | 8/1936 | Rubens | 2/91 |
| 4,485,494 | A | 12/1984 | Segol | |
| 4,797,954 | A * | 1/1989 | Williams et al. | 2/106 |
| 4,912,780 | A * | 4/1990 | Falack | 2/102 |
| 5,119,979 | A * | 6/1992 | Kallman | 224/250 |
| 5,227,215 | A * | 7/1993 | Sklar | 428/102 |
| H1361 | H * | 10/1994 | Tardiff et al. | 128/206.12 |
| 6,041,441 | A * | 3/2000 | Counts et al. | 2/227 |
| 7,334,269 | B2 | 2/2008 | Segol | |
| 7,596,814 | B1 * | 10/2009 | Corby et al. | 2/114 |
| 7,802,317 | B2 | 9/2010 | Segol | |
| 8,122,520 | B2 * | 2/2012 | Wilson, II | 2/237 |
| 8,235,766 | B2 * | 8/2012 | Melarti et al. | 450/155 |
| 2003/0163861 | A1 * | 9/2003 | Avrahami | 2/69 |
| 2004/0010837 | A1 * | 1/2004 | Graves | 2/114 |
| 2006/0143779 | A1 * | 7/2006 | Lee | 2/115 |
| 2008/0109931 | A1 * | 5/2008 | Mamo | 2/88 |
| 2008/0271223 | A1 * | 11/2008 | Cohen | 2/113 |
| 2009/0144877 | A1 * | 6/2009 | Barkai | 2/113 |
| 2009/0270012 | A1 * | 10/2009 | Melarti et al. | 450/8 |
| 2011/0154555 | A1 * | 6/2011 | Messika | 2/115 |

FOREIGN PATENT DOCUMENTS

| | | |
|---|---|---|
| IL | 165143 | 6/2010 |
| IL | 165144 | 12/2010 |

* cited by examiner

*Primary Examiner* — Khoa Huynh
*Assistant Examiner* — Andrew W Collins
(74) *Attorney, Agent, or Firm* — Hahn Loeser Parks LLP; Carlos P. Garritano

(57) ABSTRACT

The claimed subject matter provides a tzitzit garment that meets halachic (e.g., Jewish law) requirements for wearing tzitzit strings (e.g., fringes) on the corners of a four-cornered garment. The tzitzit garment includes two layers, including an under layer that is made of compression material that wicks perspiration away from the body of a wearer and an outer layer that is a four cornered garment, has tzitzit strings at each of the four corners and is attached to the under layer. Furthermore, the claimed subject matter provides a pant garment that includes grips to hold the tzitzit strings in place to prevent interference during physical activity.

20 Claims, 4 Drawing Sheets

TZITZIT GARMENT

CROSS-REFERENCE TO RELATED APPLICATIONS

This application claims the benefit of U.S. Provisional Patent Application No. 61/432,308, filed Jan. 13, 2011, and entitled "TZITZIT GARMENT." The entirety of the aforementioned application is incorporated herein by reference.

BACKGROUND

A tzitzit garment is a four cornered garment with specially braided strings or fringes, known as "tzitzit," attached to each corner that Jewish males are required to wear according to Jewish law, and that observant Jewish men have worn since ancient times. The body of the tzitzit garment is traditionally constructed of a basic material such as wool or cotton that fits either as a simple four cornered garment with a hole cut out for the head to pass through, thereby allowing the garment to loosely drape down on the wearer's torso, or as a sleeveless undershirt style garment with four corners and tzitzit strings (e.g., fringes) attached to each bottom corner.

Some Jewish males choose not to wear traditionally constructed loose fitting tzitzit garments for various reasons. Tzitzit garments constructed in the traditional loose design of simple materials like cotton or wool are incompatible with a modern aesthetic, appear bulky contributing to a creased or wrinkled appearance, and can feel cumbersome and uncomfortable under some conditions such as in warm weather or while exercising.

Observant Jewish male athletes, in particular, experience many inconveniences when donning traditionally constructed tzitzit garments. For example, for the wearer who engages in sport or physical activity, traditionally constructed tzitzit garments worn as undergarments are bulky, may not allow for the freedom of movement necessary when participating in sports or strenuous activity, and can be too hot when worn in indoor facilities or in warm weather, therefore leading to unpleasant odors, skin chafing and other irritating skin conditions.

Moreover, athletes are often bound by league or gym regulations which specify the types of jerseys or clothing that are permissible and these specifications often do not allow for the inclusion of traditional undergarment tzitzit garments. Additionally, traditional tzitzit garments worn under an outer layer often hinder athletic performance because their added bulk restricts the wearer's body movement.

Some Jewish athletes who wear tzitzit garments during training resort to various methods to try to lessen the tzitzit's negative impact on their performance. For example, when Tamir Goodman played professional basketball in Israel he used tape to narrow the garment's width between his neck and shoulder so that the material would not impede his shooting form. Finally, the tzitzit garment constructed in the traditional design and from traditional materials can become damaged when exposed to conditions that are incompatible with the intended use of the fabric and garment. For example, wool and cotton garments can lose their shape, become stained, faded or discolored, retain unpleasant odors when exposed to repeated bodily movements and excessive sweat, and can chafe or irritate the wearer's skin.

SUMMARY

The following presents a simplified summary of the innovation in order to provide a basic understanding of some aspects described herein. This summary is not an extensive overview of the claimed subject matter. It is intended to neither identify key or critical elements of the claimed subject matter nor delineate the scope of the subject innovation. Its sole purpose is to present some concepts of the claimed subject matter in a simplified form as a prelude to the more detailed description that is presented later.

The subject innovation relates to a tzitzit garment that is optimized for physical activity. In general, the tzitzit garment is an under layer made of a form-fitting, moisture wicking material that is combined with a Jewish Law abiding outer layer. In other words, the under layer and the outer layer are connected thereto such that the outer layer is outside of the under layer to form the tzitzit garment. As stated, the under layer is made of a compression-type material that form-fits the wearer. The outer layer conforms to Jewish Laws by being a four-cornered structure in which a front portion of the outer layer and a back portion of the outer layer are connected at a top two corners and a bottom two corners respective to the front portion and the back portion. Furthermore, the outer layer includes attached tzitzit strings on each of the bottom corners (e.g., bottom two corners of the front portion and bottom two corners of the back portion). Additionally to adhere to Jewish Law, each side of the outer layer (e.g., the front portion and the back portion) is connected such that a stitched or connection portion is shorter than a non-stitched or unconnected (e.g., opened) in length.

An aspect of the invention relates to a tzitzit garment having compression design in conjunction with high performance fabric containing anti-microbial, anti-odor, moisture wicking properties, and UV protection.

According to another aspect, the tzitzit garment is constructed of two layers, an under layer and an outer layer. The under layer is a high performance compression shirt, while the outer layer is sewed on top of the under layer.

According to another aspect, the outer layer is sewed onto the under layer at specific points-around an armhole opening and extending from the armpit down each side a short distance or length so that a majority of the garment is still open and remains a four cornered garment. The ritual fringes (tzitzit) are attached at each of the four corners of the outer layer.

According to another aspect, the manner in which the garments are sewed together allows the tzitzit garment to offer a compression fit while also adhering to Jewish law which requires tzitzit to be a four cornered garment in which the majority or the length of the sides of the tzitzit garment must be open and not sewed together.

Additional aspects relate to the tzitzit garment being customizable in terms of color, sleeve length, and with personal or team logos. The tzitzit garment also may serve as a jersey for sports teams, eliminating the need for observant players to wear traditionally constructed tzitzit under their team jersey.

The following description and the annexed drawings set forth in detail certain illustrative aspects of the claimed subject matter. These aspects are indicative, however, of but a few of the various ways in which the principles of the innovation may be employed and the claimed subject matter is intended to include all such aspects and their equivalents. Other advantages and novel features of the claimed subject matter will become apparent from the following detailed description of the innovation when considered in conjunction with the drawings.

DETAILED DESCRIPTION

Figure 1:
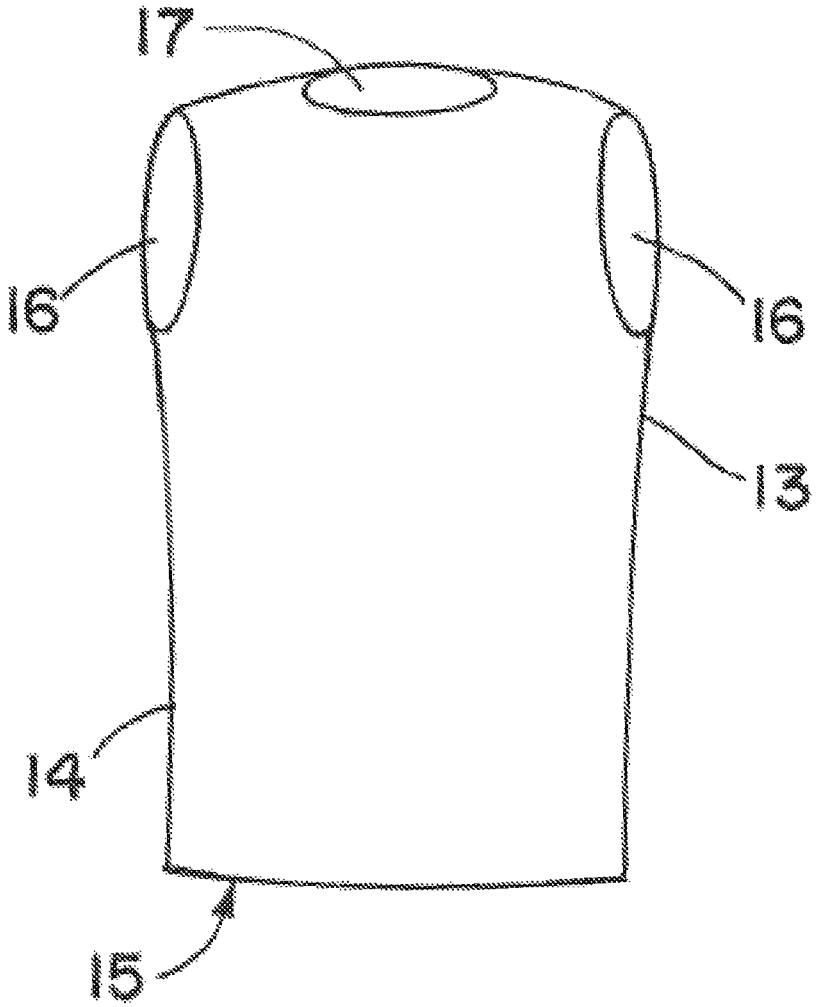
FIG. 1 illustrates an under layer compression garment made of a fabric, the fabric of which has high performance properties like moisture wicking, anti-microbial, and UV protection.

The subject innovation relates at least in part to a tzitzit garment. The tzitzit garment is an under layer made of a form-fitting, moisture wicking material that is combined with a Jewish Law abiding outer layer. In other words, the under layer and the outer layer are connected thereto such that the outer layer is outside of the under layer to form the tzitzit garment. The outer layer conforms to Jewish Laws by being a four-cornered structure in which a front portion of the outer layer and a back portion of the outer layer are connected at a top two corners and a bottom two corners. Furthermore, the outer layer includes attached tzitzit strings on each of the bottom two corners for the front portion and the bottom portion (e.g., four (4) corners that include two (2) corners on a bottom of the front portion of the outer layer and two (2) corners on a bottom of the back portion of the outer layer). Additionally to adhere to Jewish Law, each side of the outer layer (e.g., the front portion and the back portion) is connected such that a stitched or connection portion is shorter than a non-stitched or unconnected (e.g., opened) in length.

The claimed subject matter is described with reference to the drawings, wherein like reference numerals are used to refer to like elements throughout. In the following description, for purposes of explanation, numerous specific details are set forth in order to provide a thorough understanding of the subject innovation. It may be evident, however, that the claimed subject matter may be practiced without these specific details. In other instances, well-known structures and devices are shown in block diagram form in order to facilitate describing the subject innovation.

Features that are described and/or illustrated with respect to one embodiment may be used in the same way or in a similar way in one or more other embodiments and/or in combination with or instead of the features of the other embodiments. These and further aspects and features will be apparent with reference to the following description and attached drawings. In the description and drawings, particular embodiments of the subject innovation have been disclosed in detail as being indicative of some of the ways in which the principles of the subject innovation may be employed, but it is understood that the subject innovation is not limited correspondingly in scope. Rather, the subject innovation includes all changes, modifications and equivalents coming within the scope of the claims appended hereto. The accompanying illustrations are examples of the subject disclosure, but the innovation can appear in various embodiments depending on varying sleeve lengths and personal customizations that are not illustrated here.

Of course, those skilled in the art will recognize many modifications may be made to this configuration without departing from the scope or spirit of the claimed subject matter. Moreover, the word "exemplary" is used herein to mean serving as an example, instance, or illustration. Any aspect or design described herein as "exemplary" is not necessarily to be construed as preferred or advantageous over other aspects or designs. It should be emphasized that the term "comprises/comprising" when used in this specification is taken to specify the presence of stated features, integers, steps or components but does not preclude the presence or addition of one or more other features, integers, steps, components or groups thereof.

Figure 2:
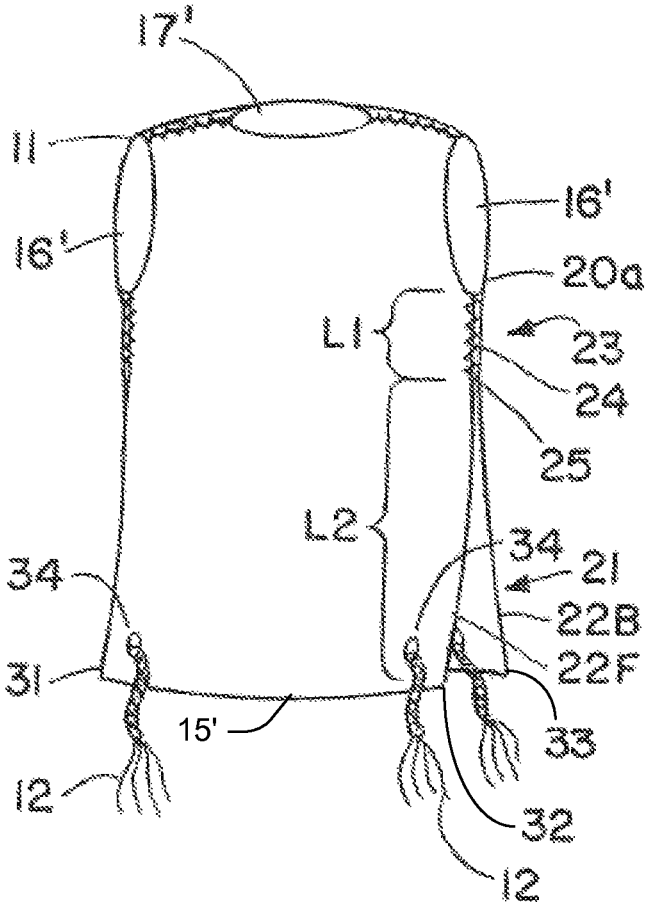
FIG. 2 is an illustration that depicts an outer layer which is sewed onto an under layer around arm holes and extending briefly down each side.
Figure 3:
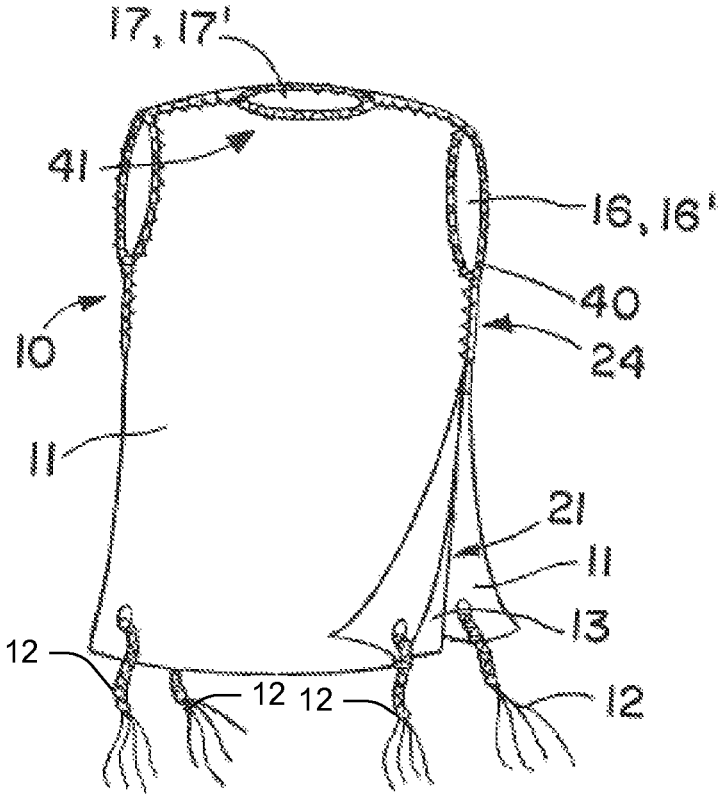
FIG. 3 is an illustration that shows a complete tzitzit garment that includes an outer layer and an under layer.

Referring to the drawings, FIGS. 1-3 illustrate the parts of the tzitzit garment and the assembled parts as a tzitzit garment 10 (shown in FIG. 3). The tzitzit garment 10 includes a modern compression design that can be worn both as a primary article of clothing or as an undergarment under regular attire. Whereas traditionally constructed tzitzit garments either hang very loosely on the body or fit like a regular cotton undershirt, the tzitzit garment 10 has a compression design that fits snugly on the body of the wearer. The compression fit on the body provides the same compact fit and sleek manner as regular compression sportswear shirts and/or apparel, and will tend to cause the tzitzit garment to appear as though the wearer is wearing a regular (e.g., non-tzitzit or religious apparel) sport shirt. The tzitzit garment 10 has an outer layer 11 (shown in FIG. 2) that has the ritual fringes 12 attached to it. The outer layer 11 is attached to an under layer (e.g., compression shirt) 13 (shown in FIG. 1), for example, by sewing, to enable the tzitzit garment 10 to both function as a compression shirt while meeting the requirements of Jewish law.

The size of the tzitzit garment 10, the shape, including the manner of cutouts for arms and head, for example, and the ritual fringes 12 attached to the tzitzit garment 10 fulfill the halacha (Jewish law requirements) for wearing fringes on four cornered garments. By way of example and not limitation, the halacha requirements can be, but are not limited to, the outer layer 11 comprises of materials using at least 51% cotton; a majority of the outer layer 11 length from each armhole down is open (e.g., not attached or sewn together with a front portion of the outer layer 11 and a back portion of the outer layer 11) on both sides, thereby ensuring this is a four cornered garment requiring tzitzit strings; tzitzit string is knotted into an opening (e.g., hole) such that the tzitzit string can hang loosely from the hole but also that the knot is not loose (e.g., no space between the knot and the bottom of the shirt) nor bunched up on the shirt (e.g., so tight that the bottom of the outer layer 11 does not hang freely); and the tzitzit string is attached to an opening (e.g., hole) on the outer layer 11 and such hole is no less than four (4) centimeters and no more than six (6) centimeters (e.g., between approximately four (4) centimeters and six (6) centimeters) diagonally from a corner on the bottom of the outer layer 11 (e.g., bottom of the front potion includes two corners and bottom of the back portion includes two corners, where the front portion and the back portion form the outer layer 11). It is to be appreciated that the tzitzit garment 10 is intended to satisfy any and all halacha (e.g., Jewish Law requirements). However, the tzitzit garment 10 may be created such that subset of halacha requirements are fulfilled. In other words, the tzitzit garment 10 may satisfy at least one of the halacha requirements.

The tzitzit garment 10 is formed of the under layer 13 (also referred to as a compression shirt 13 or compression shirt portion 13 below) and the outer layer 11, the outer layer is connected on an outside of the under layer to create a single wearable garment referred to as a tzitzit garment 10.

The novel compression design offers many benefits to Jewish observant athletes as well as the general Jewish observant male population. Athletes who wear the tzitzit garment 10 will be able to train and perform in a stylish and modern garment that eliminates the need for them to wear a tzitzit undergarment with a shirt over it in order to fulfill the commandment to wear tzitzit. The compression design, along with the high performance properties of the fabric of the compression shirt 13 (under layer 13), affords the wearer freedom of movement to enhance training and performance, is not cumbersome, helps the wearer stay cool, and eliminates the need for bulky layers of clothing that impede speed, agility, and general comfort during physical and daily activities. Examples of some high performance properties are the sleek fit so as not to impede physical activity, wicking of moisture away from the body for comfort and compression that tends to give a sense of strength and confidence. Additionally, the compression design molds to the body of the wearer and enhances and withstands intense physical training, unlike traditionally constructed tzitzit garments, thereby eliminating unpleasant odors and many of the irritating skin conditions like chafing and rashes that may ensue when traditional tzitzit garments are worn during prolonged physical exertion and exposed to sweaty conditions. Additionally, the tzitzit garment 10 does not hinder any movements of the wearer (e.g., athlete).

The general observant Jewish male population, including youth, teens, and adults who wear the tzitzit garment 10 not for the express purpose of sport or physical activity, also may enjoy many novel benefits from the compression design of the invention. The compression design fits over the wearer's body more smoothly than traditionally constructed undergarment tzitzit. The sleek fit of the tzitzit garment 10, therefore, contributes to a physique that appears more trim and neat. The compression design also does not feel cumbersome to the wearer, contributing an added element of comfort for observant men who with traditionally constructed tzitzit garments would need to wear multiple layers of clothing even in warm weather and climates to fulfill the requirements of Jewish law. The slim-fitting compression design that is comfortable in a range of climatic temperatures and conditions lets the everyday wearer move freely and comfortably to enhance his ability to engage in day to day activities, whether the product is worn under other clothes or as a regular shirt.

The tzitzit garment 10 offers the person wearing it (the wearer) the choice of varying sleeve lengths, a selection of fabric colors, and the option to customize the product with logos, names, and symbols that may be imprinted on the front or back of the jersey. The tzitzit garment 10 can also uniquely serve as a jersey for sports teams to streamline their apparel by combining the jersey and the tzitzit garment into one innovative garment. Therefore, the outer layer 11 may be imprinted with a name, logo, number, etc., e.g., for identification or pride, etc., and there is no need to wear a separate jersey on top of the tzitzit garment 10 with such printing or the like.

The tzitzit garment 10 may be provided in a selection of sleeve lengths including sleeveless, short sleeve, three-quarter (¾) sleeve, long sleeve, and/or any length of sleeve in-between no sleeve and long sleeve. These options enable the consumer to choose which style best fits his unique needs. For example, consumers who live in warm climates may choose the sleeveless option while those residing in cooler climates may opt for the long sleeve option. Similarly, consumers can choose the appropriate sleeve length that best complements the activities during which they will wear the tzitzit garment 10. For example, a customer who is wearing the tzitzit garment 10 as a primary article of clothing for the purpose of exercising in an air-conditioned gym would perhaps choose the short sleeve option for maximum comfort.

The tzitzit garment 10 can be in any suitable color. For example, consumers can also select their color preference when purchasing the tzitzit garment 10. In particular, consumers can choose the color based on their personal preferences and will then have the option of customizing the tzitzit garment 10 with logos, names or symbols which will appear thereon. Consumers can choose, for example, to have their last name imprinted on the top back of the tzitzit garment 10 or to have their school's name and symbol appear on the front of the tzitzit garment. In another embodiment, the tzitzit garment 10 can be customized to serve as a team jersey with the team's name, logo or other symbol imprinted on the front and back thereof In this embodiment, the tzitzit garment 10 is a jersey and tzitzit garment 10 in one, thereby eliminating the need for athletes participating in organized sports to wear an undergarment tzitzit with a jersey on top. This streamlined apparel, the tzitzit garment 10, will help athletes perform at their best in comfort and style.

The tzitzit garment 10 meets the unique needs of observant male athletes and is beneficial to all observant Jewish men who lead active lifestyles, who are seeking a comfortable and stylish alternative to traditionally constructed tzitzit, and who want the option to customize their tzitzit garment to enhance personal style, comfort, or to streamline their apparel.

In FIG. 1 an under layer 13 (e.g., also referred to as a compression shirt 13) is illustrated. The under layer 13 has a body 14 and a bottom 15 that may be slipped over a user's head, for example, sleeve openings or arm openings 16, and a head opening 17. The under layer 13 may be made of various materials, for example a compression material. An exemplary material is that which is resilient in that it fits relatively closely to the body of the wearer and also has properties of wicking moisture away from the body, such as removing perspiration from the body toward the outside of the shirt. Additionally, the material can be elastic in order to form-fit the wearer which reduces heat escape from muscles of the wearer. By way of example and not limitation, the under layer 13 can be made from, but not limiting to, nylon, polyester, SPANDEX™ material, SPANDEX™-type material, elastic material, and/or any other suitable material that form-fits a body of the wearer. For instance, such material can include anti-microbial, wicking moisture characteristics, among others, and also may have ultraviolet (UV) protection functions.

The size of the compression shirt 13 (e.g., under layer 13) should be suitable to fit on the body of a person wearing the shirt (wearer) relatively snugly (e.g., form-fitting) adhering to the body so as not to loosely move away from the body. The degree or extent or amount of compression provided by the compression shirt 13 (e.g., under layer 13) against the body may vary, depending on the tastes and desires of the wearer. Since the compression shirt 13 (e.g., under layer 13) fits closely to the body, it does not "flop" up or "ride" up as a loose shirt might; and, therefore, it does not get in the way of physical activity or movement, such as, for example, shooting a basketball, passing a basketball, catching a basketball, dribbling a basketball, running, working out, cardio training, weight training, throwing/catching a ball (e.g., football, baseball, etc.), among others. In other words, the shirt does not detrimentally affect or hinder movement and/or performance of the wearer.

Turning to FIG. 2, an outer layer 11 of the tzitzit garment 10 is illustrated, wherein the majority of each side remains open while the top section, closest to an arm hole, is sewed onto the under layer. The tzitzit strings (e.g., ritual fringes) can be attached to each of the four corners of the outer layer 11. The outer layer 11 may be made of high performance material similar to that of which the under layer (e.g., compression shirt) 13 is made. Therefore, the outer layer will provide similar performance of wicking moisture away from the body, e.g., after the moisture may have been wicked away from the body via the compression shirt 13. Also, the outer layer 11 may be of compression material so as to fit relatively closely to the body of the wearer in a manner similar to that of which the under layer 13 (e.g., compression shirt 13) fits.

Thus, together, the two layers, namely the outer layer 11 and the under layer 13 (e.g., compression shirt 13) adhere relatively closely to the body providing a compression fit (e.g., form-fitting) or to some extent a compression fit, thereby not getting in the way detrimentally relative to the performance of the wearer, as was mentioned above, and at the same time provide the various advantages mentioned above. Furthermore, the outer layer 11 may have characteristics of ultraviolet radiation (UV) protection.

The outer layer 11, prior to forming it in a shape for wearing by a user, may be a rectangular fabric sheet having an opening of a size to fit over the head of a wearer. In particular and in accordance with Jewish Law, the outer layer 11 can include a front portion 22*f* (e.g., front part 22*f*) and a back portion 22*b* (e.g., back part 22*b*) that can be connected or sewn together as discussed above. By example and not limitation, the front portion 22*f* of the outer layer 11 and the back portion 22*b* of the outer layer 11 can be sewn together as illustrated in FIG. 2 (discussed in more detail below).

The outer layer 11 may be formed by any suitable material. By way of example and not limitation, the outer layer 11 can be made from the same material as the compression shirt 13 (e.g., under layer 13). It is to be appreciated that the outer layer 11 can include a length (referred to as "L2") from a bottom 15' of the outer layer 11 to a bottom 20*a* of an arm opening 16' that includes a portion that is a slit or in any event is not sewn together between the front portion 22*f* (e.g., front part 22*f*) and the back portion 22*b* (e.g., back part 22*b*). Therefore, the front portion 22*f* and back portion 22*b* of the outer layer 11 are not attached to each other from the bottom 15' to a location 23 below the bottom 20*a* of the arm opening 16'. A stitched length 24 (also depicted as "L1") is where the front portion 22*f* and back portion 22*b* of the outer layer 11 are attached to each other. The stitched length 24 from the bottom 20*a* of the arm opening 16' to a point 25 or location 25 where the front portion 22*f* and back portion 22*b* are attached at 24 is the length "L1." It is to be appreciated that "L1" can be, for instance, less than in length than a length associated with "L2." In other words, the length "L1" is shorter than the length "L2" where the front portion 22*f* (e.g., front part 22*f*) and back portion 22*b* (e.g., back part 22*b*) are not attached (e.g., sewn together, joined, etc.). This distance relation of "L1" and "L2" and the separation or lack of attachment of the front portion 22*f* (e.g., front part 22*f*) and back portion 22*b* (e.g., back part 22*b*) allow the tzitzit garment 10 to meet the requirements of Jewish law for a tzitzit garment 10 configuration. In other words, the outer layer 11 includes stitching or connection in an area depicted as "L1" and no stitching or connection in area "L2." For the sake of brevity, the description of how the front portion 22*f* and the back portion 22*b* of the outer layer 11 are connected or sewn together is for a single side of the tzitzit garment 10 and it is to be appreciated that each side is connected or sewn together in a substantially similar manner.

It will be appreciated that the outer layer 11 may be formed as a rectangular sheet of material having an opening 17' for the head, and the material may be folded in half and partly stitched in the stitched length 24. Alternatively, the outer layer 11 may be formed in the same manner as the compression shirt 13 (e.g., under layer 13) and a portion 21 may be slit by a knife or other cutting instrument to separate the front portion 22*f* and back portion 22*b* from each other leaving a space (e.g., "L2") or separation between them as illustrated in FIG. 2. For example, the portion 21 (e.g., also referred to as a separate area portion 21) can be slit in which an amount slit or cut is representative of the length "L2." It is to be appreciated that in accordance with halacha requirements, the length "L2" (e.g., opened or not connected portions of the front part 22*f* and the back part 22*b*) is a greater length than the length "L1" (e.g., stitched, connected, or sewn together portions of the front part 22*f* and the back part 22*b*).

The formation of the outer layer 11 as described thus provides for separate corners of the garment, three of which are illustrated at 31, 32, 33, the fourth corner not being seen in the drawings due to a perspective view of the outer layer 11.

Attached near the respective corners are the tzitzit strings 12. The tzitzit strings may be attached through a respective opening 34 in the fabric of which the outer layer 11 is made and may be tied in a traditional manner and extend or hang relatively freely downward vertically as a wearer stands erect, for example.

Although, as was mentioned above, the outer layer 11 may be formed of compression material, it is to be appreciated that the outer layer 11 may be formed of more conventional fabric or material that is not compression material. Since the outer layer 11 and the under layer 13 (e.g., compression shirt 13) are attached to form the tzitzit garment 10 (as shown in FIG. 3), the outer layer 11 would not "flop" up or "ride" up as to get in the way of performance of the wearer, as was mentioned above, even if the outer layer 11 were not compression material.

Although the under layer 13 (e.g., compression shirt 13) and the outer layer 11, regardless of what material the outer layer 11 is made from, are two shirts or pieces of apparel, they would feel to a wearer as though a single shirt or as a single layer when worn.

Turning to FIG. 3, the tzitzit garment 10 is illustrated. In general, the under layer 13 and the outer layer 11 can be stitched together around the arm holes and extending briefly down each side, while the majority of each side remains open (unstitched) so the tzitzit garment 10 remains a four cornered garment in accordance with Jewish law. Moreover, the tzitzit strings can be attached to the four corners of the outer layer 11 through openings. As is seen in FIG. 3, the tzitzit garment 10 includes the outer layer 11 that is above, over, outside, etc. the under layer 13 (e.g., compression shirt 13). Only a portion of the under layer 13 (e.g., compression shirt 13) is seen at the slit or the separate area portion 21 of the outer layer 11 and also at the respective arm and head openings 16, 16', 17, and 17'. The outer layer 11 and the under layer 13 (e.g., compression shirt 13) are attached to each other by stitching 40 about the arm openings 16 (respectively, 16 and 16' of the under layer 13 and outer layer 11) and similar stitching 40 about a neck area and similar stitching 40 around an opening 17, 17' for the head. It is to be appreciated that any suitable stitching 40 may exist in order to combine the under layer 13 with the outer layer 11 and the above and below examples are not to be limiting on the subject disclosure. By way of example and not limitation, there may be some stitching 40 attaching the under layer 13 and outer layer 11 at the top 41 of the tzitzit garment 10 at the shoulder area thereof, and possibly also in the area 40 at the sides of the under layer 13 and outer layer 11 in the area beneath the arm openings and above the separate area portion 21.

In use of the tzitzit garment 10, a person may place the garment over his head, extending the head through the head opening 17, 17' and extending the arms through the arm openings 16, 16'. The user may wear the tzitzit garment 10 during physical activity (e.g., playing a sport, training, recreational sports, competitive sports, among others) as well as in leisure or comfort apparel. It is to be appreciated that the construction of the tzitzit garment 10 is not to be limited based on the intended purpose or activity of the wearer. The tzitzit garment 10, which includes the under layer 13 and the outer layer 11, may fit relatively snug (e.g., form-fitting) against the body of the wearer.

Figure 4:
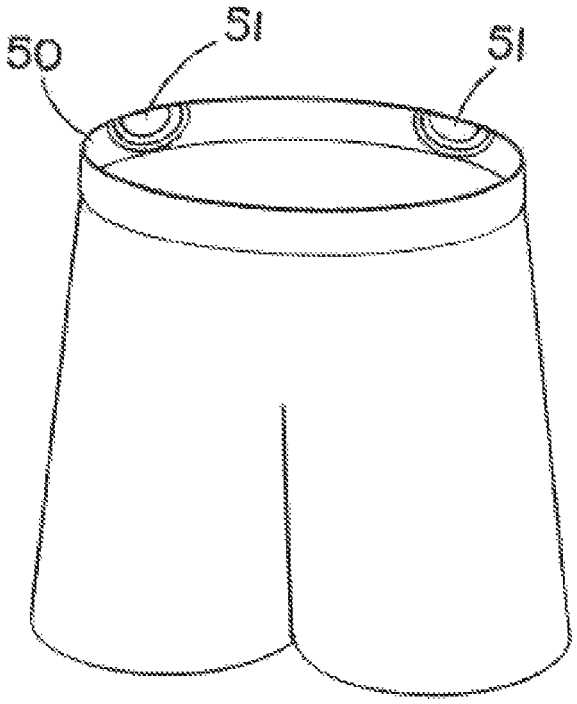
FIG. 4 shows a garment with grips to hold a portion of a tzitzit string in a particular position.

Turning to FIG. 4, a garment 50 is illustrated. By way of example and not limitation, the garment 50 can be athletic shorts (e.g., sport shorts, basketball shorts, mesh shorts, compression shorts, etc.) or athletic pants. The garment 50 can include a grip 51 to hold a portion of the tzitzit strings 12 (not shown) in place during physical activity. By way of example and not limitation, the grips 51 can maintain the position of a fringe of a tzitzit string 12. For the sake of brevity, the garment 50 illustrates two (2) grips 51, yet it is to be appreciated that the garment 50 can include any suitable number of grips in order to maintain a respective tzitzit string 12. For instance, the garment 50 can include four (4) grips 51, one for each tzitzit string 12 on the outer layer 11 of the tzitzit garment 10 (as shown in FIG. 3). In another example (discussed in more detail below), the garment 50 can include a grip 51 on each leg of the garment 50, wherein one grip 51 maintains the position of a front tzitzit string and a back tzitzit string on one side and another grip 51 maintains the position of a front tzitzit string and a back tzitzit string on the other side.

By holding a portion of the tzitzit strings 12 (not shown) in place, they will not get in the way as to impede physical movement and/or activity by the wearer, to distract another player, or otherwise unacceptably flow too freely in space during sport activity or physical activity. The grips 51 may be, for example, elastic material that resiliently holds to the portions of the tzitzit strings 12 (e.g., tzitzit fringes). It is to be appreciated that the grips 51 can be any suitable material that allows a position of the tzitzit strings 12 to be maintained. By way of example and not limitation, the grips 51 can include any suitable sticky material to ensure the tzitzit strings 12 stick to the grips 51. For instance, the grips 51 can be replaceable pads that attach to the garment 50 that have a chemical-based sticky surface. Thus, following this example, when a "stickiness" of the replacement pad wears-off, a new and fully sticky replacement pad can be attached to the garment 50.

In still another example, the grips 51 may be made of Velcro™ material that allows the grips 51 to be enlarged or made smaller and/or to grasp or fasten to the material of which the pants garment is made. Thus, the grips 51 may be substantially permanently attached to the garment 50 or may be removable and replaced. As illustrated, the grips 51 may be somewhat curved or circular as to receive the tzitzit strings 12 in a relationship to encircle the tzitzit strings 12 to hold a portion thereof (e.g., fringes), as was mentioned above.

It is to be appreciated that any suitable number of grips 51 can be included with the garment 50. By way of example and not limitation, there may be two grips 51, each nearer one side (left and right) of the garment 50 and may be positioned to hold the pair of front and back tzitzit fringes on one side of the tzitzit garment 10. Alternatively, there may be a separate grip 51 for each group of tzitzit fringes—it being noted that each tzitzit string 12 actually usually is a collection of strings or string-like members making up the respective tzitzit fringe.

Other types of grips 51 also may be used. The grips 51 may be located at the inside or outside of the garment 50 or may be through the garment 50; they may be near a waist band, e.g., near a top of the garment 50 or further down, e.g., depending on a size/length of the tzitzit string 12 and a size of the garment 50 and the manner in which it typically is worn—placement or location of the grips 51 may be strategic based upon the desired use, e.g., sport, type, size, manner of wearing, and type of garment 50 to carry out the described function of the grips.

Together, the tzitzit garment 10 and the garment 50 may compose a sports uniform. A portion of the tzitzit strings depend from the tzitzit garment 10 and are held in position by the one or more grips 51 of the garment 50.

What has been described above includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims.

Specific embodiments of an innovation are disclosed herein. One of ordinary skill in the art will readily recognize that the innovation may have other applications in other environments. In fact, many embodiments and implementations are possible. The following claims are in no way intended to limit the scope of the subject innovation to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but generally known by those of skill in the art.

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., components, assemblies, devices, compositions, garments, materials, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A tzitzit garment, comprising:

an under layer made of a compression material that includes a head opening and two arm openings, wherein the compression material is an elastic material that compresses against a wearer based on an elastic property of the elastic material;

an outer layer that includes a front portion and a back portion each having a bottom with two respective corners in which a tzitzit string is connected to each corner, the front portion and the back portion are connected together to include head opening and arm openings, wherein the front portion and the back portion are connected together with a stitching; and the under layer and the outer layer being permanently attached together as a single garment, wherein the under layer and the outer layer are permanently attached with an additional stitching;

the additional stitching is located on the outer layer and the under layer at the following:

a position between the head opening and at least one of the two arm openings;

a position around a perimeter of the head opening; or a position under the two arm openings.

2. The tzitzit garment of claim 1 wherein the stitching to fasten the front portion and the back portion of the outer layer together as the single garment is positioned along each side of the outer layer and below each arm opening while leaving an unattached slit between the front portion and the back portion, wherein a length of the stitching is shorter than a length that is not stitched on each side of the outer layer.

3. The tzitzit garment of claim 2, wherein the compression material of the under layer comprises a wicking material providing wicking of perspiration away from a body of a wearer.

4. The tzitzit garment of claim 2, wherein the outer layer comprises a compression material that provides wicking of perspiration away from a body of a wearer.

5. The tzitzit garment of claim 2, the length of the stitching connecting the front portion and the back portion of the outer layer leaves a sufficient unattached length of each side of the outer layer free from each other in order to meet a Jewish law requirement for a four cornered garment.

6. The tzitzit garment of claim 2, wherein the outer layer comprises material that is not compression material.

7. The tzitzit garment of claim 2, the tzitzit garment is a uniform for competition in a sport.

8. The tzitzit garment of claim 7, wherein the uniform comprises a team logo visible on an outside of the outer layer.

9. The tzitzit garment of claim 7, further comprising pants.

10. The tzitzit garment of claim 7, wherein the pants include at least one grip that maintain a position of a portion of the tzitzit string while the tzitzit garment and pants are worn and the grip is a section of material replaceably integrated into the pants, the grip being a first material and the pants being a second material, wherein the position is maintained based on the grip having an adhesive property to adhere to the bottom portion of the Tzitzit string.

11. The tzitzit garment of claim 2, the outer layer is made from at least fifty-one percent (51%) cotton.

12. The tzitzit garment of claim 2, each tzitzit string is attached to the outer layer at a location on each corner of the bottom of the front portion and the back portion, the location is between four (4) and six (6) centimeters diagonal from each corner.

13. A uniform for sports, comprising:

an under layer that includes a head opening and a first arm opening and a second arm opening;

an outer layer that includes a front portion and a back portion with a tzitzit string attached to a bottom of each of corner of the front portion and the back portion, the front portion and the back portion are connected to form a head opening and a first arm opening and a second arm opening, wherein the front portion and the back portion are connected together with a first stitching;

the outer layer includes a first side that is from a bottom of the outer layer to a bottom of the first arm opening, a first portion of the first side is stitched to connect the front portion to the back portion with a second stitching and a second portion of the first side is unconnected;

the outer layer includes a second side that is from the bottom of the outer layer to a bottom of the second arm opening, a first portion of the second side is stitched to connect the front portion to the back portion with a third stitching and a second portion of the second side is unconnected;

the under layer and the outer layer are permanently attached together as a single garment with the outer layer being on an outside of the under layer, wherein the under layer and the outer layer are permanently attached with a fourth stitching;

the fourth stitching is located on the outer layer and the under layer at the following:

a position between the head opening and at least one of the two arm openings;

a position around a perimeter of the head opening; or a position under the two arm openings; and a shorts garment that includes a grip to maintain a position of at least a bottom portion of the tzitzit string, the grip is a section of material on a waist-line of the shorts garment, wherein the position is maintained based on the grip having an adhesive property to adhere to the bottom portion of the tzitzit string; and the shorts garment being made from a first material and the grip being made from a second material, the second material has the adhesive property to maintain the position of at least the bottom portion of the Tzitzit string.

14. The uniform for sports of claim 13 further comprises:

the first portion of the first side is shorter in length than the second portion of the first side; and the first portion of the second side is shorter in length than the second portion of the second side.

15. The uniform for sports of claim 14, at least one of the shorts garment or an outside of the outer layer includes a team logo.

16. The uniform for sports of claim 15, the outside of the outer layer includes at least one of a number, or a last name of a person.

17. The uniform for sports of claim 15, the outer layer is sleeveless and the under layer is sleeveless.

18. A tzitzit garment, comprising:

an under layer that includes a head opening and a first arm opening and a second arm opening;

an outer layer that includes a front portion and a back portion with a tzitzit string attached to a bottom of each of corner of the front portion and the back portion, the front portion and the back portion are connected to form a head opening and a first arm opening and a second arm opening, wherein the front portion and the back portion are connected together with a first stitching;

the outer layer includes a first side that is from a bottom of the outer layer to a bottom of the first arm opening, a first portion of the first side is stitched to connect the front portion to the back portion with a second stitching and a second portion of the first side is unconnected;

the outer layer includes a second side that is from the bottom of the outer layer to a bottom of the second arm opening, a first portion of the second side is stitched to connect the front portion to the back portion with a third stitching and a second portion of the second side is unconnected;

the first portion of the first side is shorter in length than the second portion of the first side; and the first portion of the second side is shorter in length than the second portion of the second side; and the under layer and the outer layer are permanently attached together as a single garment with the outer layer being on an outside of the under layer, wherein the under layer and the outer layer are permanently attached with at least a fourth stitching;

the fourth stitching is located on the outer layer and the under layer at the following:

a position between the head opening and at least one of the two arm openings;

a position around a perimeter of the head opening; or a position under the first arm opening and the second arm opening.

19. The tzitzit garment of claim 18, further comprises:

the outer layer is made from at least fifty-one percent (51%) cotton; and each tzitzit string is attached to the outer layer at a location on each corner of the bottom of the front portion and the back portion, the location is between four (4) and six (6) centimeters diagonal from each corner.

20. The tzitzit garment of claim 18 in which the under layer is made from nylon, polyester, SPANDEX™ material, SPANDEX™ type material, or elastic material.

* * * * *